US006770610B2

(12) United States Patent
Takeuchi et al.

(10) Patent No.: US 6,770,610 B2
(45) Date of Patent: Aug. 3, 2004

(54) LIME SOAP DISPERSANT, AND DETERGENT COMPOSITION AND CLEANING COMPOSITION COMPRISING THE SAME

(75) Inventors: Hideo Takeuchi, Shizuoka (JP); Shigemi Kondo, Shizuoka (JP)

(73) Assignee: Clariant Finance (BVI) Limited Tortola (BV)

( * ) Notice: Subject to any disclaimer, the term of this patent is extended or adjusted under 35 U.S.C. 154(b) by 132 days.

(21) Appl. No.: 10/025,262

(22) Filed: Dec. 19, 2001

(65) Prior Publication Data

US 2002/0123441 A1 Sep. 5, 2002

(30) Foreign Application Priority Data

Dec. 21, 2000 (JP) ..... 2000-388911

(51) Int. Cl.[7] ..... C11D 17/00

(52) U.S. Cl. ..... 510/354; 570/355; 570/356; 570/362; 570/475; 570/482; 570/492; 570/528

(58) Field of Search ..... 510/354, 482, 510/475, 355, 356, 356.2, 492, 528

(56) References Cited

U.S. PATENT DOCUMENTS 6,274,541 B1 8/2001 Man

FOREIGN PATENT DOCUMENTS

JP 9509447 9/1997
JP 11511780 10/1999
WO 97/43379 11/1997

OTHER PUBLICATIONS

English abstract for JP 5117697.

*Primary Examiner*—Necholus Ogden
(74) *Attorney, Agent, or Firm*—Richard P. Silverman

(57) ABSTRACT

A lime soap dispersant comprising a polyester represented by the general formula:

$$X\text{-}[(OR^1)_{n1}(OR^2)_{n2}]_{m1}[O\text{—}A\text{—}R^3\text{—}A\text{-}(OR^4)_{n3}]_{m1}\text{—}[O\text{—}A\text{—}R^6\text{—}A\text{-}(OR^5)_{n4}]_{m2}O\text{—}A\text{—}R^3\text{—}A\text{—}O\text{-}[(R^2O)_{n5}(R^1O)_{n6}]\text{-}X$$

wherein A represents a —CO— group, $R^1$ represents a $C_{2-4}$ alkylene group, $R^2$ represents a $C_{3-4}$ alkylene group, $R^3$ represents a phenylene group, naphthylene group or biphenylene group, $R^4$ represents a $C_{2-8}$ alkylene group, $R^5$ represents a $C_{2-8}$ alkylene group, $R^6$ represents a phenylene, naphthylene or biphenylene group which may be substituted with a —$SO_3M$ or —COOM group, X represents H, a $C_{1-4}$ alkyl group, —$R^7SO_3M$ group, —$R^8$COOM group or —C(O)$R^9$ group, M represents H or water-soluble cation, and $R^7$, $R^8$ and $R^9$ independently represent a $C_{1-4}$ alkyl group, m1 and m2 are independently a number of 0 to 25 while m1+m2 is 3 to 25, n1 is a number of 1 to 40, n2 is 0 to 5, n3 is 1 to 40, n4 is 1 to 10, n5 is 0 to 5, and n6 is 1 to 40.

2 Claims, No Drawings

LIME SOAP DISPERSANT, AND DETERGENT COMPOSITION AND CLEANING COMPOSITION COMPRISING THE SAME

FIELD OF THE INVENTION

The present invention relates to a lime soap dispersant which has excellent dispersing property of lime soap (soap scum) generated during washing or rinsing, and also relates to a detergent composition and a cleaning composition comprising the lime soap dispersant.

BACKGROUND OF THE INVENTION

Soap is a detergent composed of an alkali metal salt of fatty acid and has been used for centuries as a detergent for clothes washing, body washing and face washing, due to the excellent washing performance, safety and the like thereof. However, since soap reacts with calcium ion or the like present in water to generate water-insoluble lime soap, various problems related to lime soap are caused. When water used for washing is hard water, such problems tend to be remarkably observed. When water used for washing is soft water, problems still occur because soft water also contains ions such as calcium ion. For example, when soap is used for washing clothes, the lime soap which is formed as a result of the reaction of soap with calcium ion or the like is deposited on clothes, whereby the cloth gets yellowish or give off unpleasant odor. Further, when the lime soap is deposited inside of a washing machine, the deposited lime soap, what is called "black scum", causes problems such as clogging of water-distribution pipe of the washing machine.

Toilet soap also tends to cause unpleasant odor and/or stains at a washstand or a bathroom. Examples of a dispersant which has conventionally been proposed for dispersing lime soap include ethylene oxide adduct of higher aliphatic alcohol, polyoxyethylene/polyoxypropylene block copolymer, α-sulfofatty acid methyl ester, sulfated fatty acid alkanol amide, betaine, sulfobetaine, and an amino carboxylic acid type amphoteric surfactant. However, these conventionally known lime soap dispersants do not achieve satisfactory results, although use of such conventional dispersants have shown some improvement in lime soap dispersion. Prior art which has been proposed further includes: a reference in which a polyoxyethylene alkyl ether ethyl dialkyl amine oxide type surfactant and a polyoxyethylene alkyl ether ethyl dialkyl amino acetic acid betaine type amphoteric surfactant are employed as a lime soap dispersant (Japanese Patent Application Laid-Open No. 5-117697); a reference which discloses an alkali detergent comprising as the base material a salt of alkyl ethoxy dicarboxylic acid (Japanese Patent Application Laid-Open No. 9-509447); and a reference which discloses a detergent composition comprising a specific lipolysis enzyme and a specific lime soap dispersant having lime soap dispersing ability (Japanese Patent Application Laid-Open No. 11-511780).

An object of the present invention is to provide a lime soap dispersant which has more excellent lime soap dispersing property than the conventional lime soap dispersant, as well as a detergent composition and cleaning composition comprising the lime soap dispersant.

SUMMARY OF THE INVENTION

The inventors of the present invention have discovered, as a result of eager study for solving the above-mentioned problems, that polyester having a specific structure has excellent lime soap dispersing property, thereby completing the present invention.

The present invention relates to a lime soap dispersant, which includes a polyester represented by the general formula:

$$X\text{-}[(OR^1)_{n1}(OR^2)_{n2}]\text{-}[O\text{-}A\text{-}R^3\text{-}A\text{-}(OR^4)_{n3}]_{m1}\text{-}[O\text{-}A\text{-}R^6\text{-}A\text{-}(OR^5)_{n4}]_{m2}O\text{-}A\text{-}R^3\text{-}A\text{-}O\text{-}[(R^2O)_{n5}(R^1O)_{n6}]\text{-}X \quad (1)$$

wherein A represents a —CO— group, $R^1$ represents a $C_{2-4}$ alkylene group, $R^2$ represents a $C_{3-4}$ alkylene group, $R^3$ represents a phenylene group, naphthylene group or biphenylene group, $R^4$ represents a $C_{2-8}$ alkylene group, $R^5$ represents a $C_{2-8}$ alkylene group, $R^6$ represents a phenylene, naphthylene or biphenylene group which may be substituted with a $—SO_3M$ or —COOM group, X represents H, a $C_{1-4}$ alkyl group, $—R^7SO_3M$ group, $—R^8COOM$ group or $—C(O)R^9$ group, M represents H or water-soluble cation, and $R^7$, $R^8$ and R9 independently represent a $C_{1-4}$ alkyl group, m1 and m2 are independently a number of 0 to 25 while m1+m2 is 3 to 25, n1 is a number of 1 to 40, n2 is 0 to 5, n3 is 1 to 40, n4 is 1 to 10, n5 is 0 to 5, and n6 is 1 to 40.

In the aforementioned formula, the alkylene group and the alkyl group may be either in the form of a straight chain or branched. Examples of the phenylene group include a 1,4-phenylene group, a 1,3-phenylene group and a 1,2-phenylene group. Examples of the naphthylene group include a 1,8-naphthylene group and a 1,4-naphthylene group.

Examples of the biphenylene group include a 2,2'-biphenylene group and a 4,4'-biphenylene group. Further, examples of the water-soluble cation represented by M include alkali metal such as Na and K, ammonium, and alkanol amine.

The present invention also relates to a detergent composition that comprises the polyester represented by the aforementioned general formula (1).

The present invention also relates to a cleaning composition that comprises the polyester represented by the aforementioned general formula (1).

DETAILED DESCRIPTION OF THE INVENTION

The polyester of the present invention has excellent lime soap dispersing property, and by adding an appropriate amount of the polyester to a soap based detergent, it is possible to prevent lime soap attachment to cloth, a bath tub, a washstand, a washing machine and water-distribution pipes, which is caused by the use of the soap based detergent. Further, by adding the polyester of the present invention to a surfactant-based detergent in which soap is not used as the main agent, it is possible to prevent lime soap attachment to the aforementioned materials, to which lime soap would attach in the conventional application without the use of the polyester, and it is also possible to remove lime soap which has been attached to the aforementioned materials. Yet further, by combination of the polyester to a detergent or cleaner for a bath tub, a washstand, a washing machine, toilet, water-distribution pipes, kitchen and the like, it is possible to remove lime soap attached or both lime soap and oily stains attached with lime soap in an easy and sufficient manner.

The present invention will be described further in detail hereinafter.

A lime soap dispersant of the present invention is a polyester represented by the aforementioned general formula (1), and more preferably a polyester represented by the general formula:

$$X-(OCH_2CH_2)_{n1}-[O-A-R^3-A-(OCHR^{10}CH_2)_{n3}]_{m1}-[O-A-R^6-A-(OCHR^{11}CH_2)_{n4}]_{m2}-O-A-R^3-A-O-[(CH_2CH_2O)_{n6}]-X \quad (2)$$

wherein A, $R^3$, $R^6$, X, m1, m2, n1, n3, n4, and n6 are independently the same as defined with respect to the above general formula (1), and $R^{10}$ and $R^{11}$ independently represent H or a $C_{1-4}$ alkyl group.

The lime soap dispersant composed of a polyester represented by the general formula (1) of the present invention is used in a form of mixture with a detergent composition for body washing, clothes washing or hard surface washing such as washing for tiles, enamel, pottery and the like. The detergent composition to which the lime soap dispersant is combined may be any of the conventionally known detergents, and is not restricted to the aforementioned examples. Examples of the detergent composition include: a soap based detergent typically represented by soap; and a detergent in which soap is not used as the main agent but contains a nonionic synthetic surfactant, an anionic synthetic surfactant and/or a cationic synthetic surfactant as the main agent. Further, the lime soap dispersant of the present invention may be used in a form of mixture with a cleaning composition used for eliminating stains such as lime soap attached to a bath tub, a washstand, a washing machine, kitchen, water-distribution pipes and the like.

The amount of the lime soap dispersant represented by the aforementioned general formula (1) to be combined to a detergent or a cleaner is not particularly restricted as long as the amount of the lime soap dispersant is set within the range which enables achieving the object of the present invention. Specifically, in the case of the soap based detergent, the content of the lime soap dispersant is to be 5 to 100 weight %, preferably 10 to 40 weight % per weight of the soap component. In the case of the detergent composition in which soap is not used as the main agent, the content of the lime soap dispersant is to be 0.05 to 40 weight %, preferably 0.5 to 10 weight % per weight of the detergent composition. In the case of the cleaning composition, the content of the lime soap dispersant is to be 0.05 to 100 weight % per weight of the cleaning composition, although the range may vary depending on the mode of application. If the content of the lime soap dispersant is less than the aforementioned lower limit, the lime soap dispersing effect is normally not obtained in a sufficient manner. On the other hand, if the content exceeds the aforementioned upper limit, the dispersing effect reaches a plateau state and can no longer be increased in spite of further adding the dispersant, which is not economical.

Examples of the soap-based detergent to which the lime soap dispersant of the present invention is combined include powdery or bar soap for clothes washing made of, for example, a sodium salt or a potassium salt of beef tallow fatty acid or palm oil fatty acid, toilet soap and medical soap. In the case of powdery soap, the combination of the lime soap dispersant of the present invention can be conducted by methods such as adding the lime soap dispersant to the soap base at the stage of neat soap, or by dry blending the lime soap dispersant with the finished powdery soap. In addition, in the case of bar soap, the lime soap dispersant of the present invention may be added during the process of kneading soap chips. For the temperature at which the lime soap dispersant is combined, room temperature or temperature necessary for combination may be appropriately selected.

To the soap-based detergent which contains soap as main component, other additives may be combined, in an appropriate manner, as long as the addition of these additives do not deteriorate the effect of the present invention. Examples of such additives include an anionic surfactant, a nonionic surfactant, polymer which has been made cationic, Glauber's salt, zeolite, soda ash, silicate soda, sodium citrate, carboxymethyl cellulose, titanium oxide, perfumes, a chelating agent, a colorant, an antiseptic and a UV absorbent.

The nonionic surfactant, the anionic surfactant, the cationic surfactant or the amphoteric surfactant used as the main agent in the detergent in which soap is not used as the main agent will be described in detail hereinafter. Examples of the nonionic surfactant include: of, a condensate of polyethylene oxide, polypropylene oxide or polybutylene oxide and alkylphenol; a condensation product of ethylene oxide and $C_{8-22}$ primary alcohol or secondary alcohol which is normal or branched; alkyl polysaccharide with a $C_{6-30}$ hydrophobic group and a hydrophilic group having a polysaccharide containing approximately 1.3 to 10 saccharide units such as polyglycoside; a condensation product of ethylene oxide and a hydrophobic base formed by condensation of propylene oxide and propylene glycol; a condensation product of ethylene oxide and a product produced by the reaction of propylene oxide with ethylene diamine; alkyl (e.g., $C_{8-22}$ palm oil alkyl) amine oxide; and alkyl (e.g., $C_{8-22}$ palm oil alkyl) amidoamine oxide.

Examples of the anionic surfactant include a salt of linear alkylbenzene sulfonic acid, a salt of alkyl ester sulfuric acid, a salt of alkyl sulfuric acid, a salt of alkane sulfonic acid, a salt of olefin sulfonic acid, a sulfonated polycarboxylic acid, a salt of alkyl polyglycol ether sulfuric acid, a salt of alkyl glycerol sulfonic acid, a salt of aliphatic acyl glycerol sulfonic acid, a salt of aliphatic olefin glycerol sulfonic acid, a salt of aliphatic oleil glycerol sulfuric acid, a salt of alkylphenol ethylene oxide ether sulfric acid, a salt of alkyl alkoxylated sulfuric acid, an alkyl phosphate, isethionate, N-acyl taurate, alkyl succinamate, a sulfosuccinate, monoester or diester of sulfosuccinate, acyl sarcosinate, sulfates of alkyl polysaccharide, a salt of alkyl polyethoxy carboxylic acid, resin acid, hydrogenated resin acid, and a salt of acylated amino acid such as a salt of acylated glutamic acid and a salt of acylated alanine.

Further, examples of the cationic surfactant include alkyl trimethyl ammonium halogenide, a compound represented by the general formula;

$$[R^{12}(OR^{13})_x][R^{14}(OR^{13})_y]_2R^{15}N^+X^{31} \quad (3)$$

wherein $R^{12}$ represents an alkyl group or alkylbenzyl group having 8 to 18 carbon atoms in the alkyl chain thereof, each $R^{13}$ independently represents a group selected from the group consisting of $—CH_2CH_2—$, $—CH_2CH(CH_3)—$, $—CH_2CH(CH_2OH)—$ and a mixture thereof, each $R^{14}$ represents a group selected from the group consisting of a $C_{1-4}$ alkyl group, a $C_{1-4}$ hydroxyalkyl group, a benzyl ring structure formed by bonding of two $R^{14}$ groups, and $—CH_2CHOH—CHOHCOR^{16}CHOHCH_2OH$. $R^{16}$ represents a hexose or polymer of a hexose whose molecular weight is less than 1000 or so, and represents H when y is not zero, $R^{15}$ represents the same group as $R^{14}$ or an alkyl chain, the total number of carbon atom of $R^{12}$ and $R^{13}$ is 18 or less, x and each y are independently a number of 0 to 10, the sum of y values is in the range of 0 to 15, and X is an anion; and a compound represented by the general formula;

$$R^{17}R^{18}R^{19}R^{20}N^{+}X^{31} \quad (4)$$

wherein $R^{17}$ represents a $C_{6-16}$ alkyl group, $R^{18}$, $R^{19}$ and $R^{20}$ independently represent a group selected from the group consisting of a $C_{1-4}$ alkyl group, a $C_{1-4}$ hydroxyalkyl group, a benzyl group and —$(C_2H_4\ O)_xH$, x is a number of 1 to 5, and X is an anion.

Examples of the amphoteric surfactant include alkyl ($C_{8-22}$) acetic acid betaine, alkyl ($C_{8-22}$) amidopropyl betaine and alkyl imidazolium betaine.

As the additives to be added to the detergent composition in which soap is not used as the main material, any of those which have conventionally been employed as the additive component of the detergent composition in which soap is not used as the main material can be used. Examples of the additives include polymer which has been made cationic, a chelating agent, citric acid and a salt thereof, a builder, an enzyme, a bleach, a defoaming agent, a softener, a stain-reattaching-preventing agent, a stain suspending agent, a fluorescent brightner, a germicide, an antibacterial, an antiseptic, perfumes, and an abrasive.

The detergent composition may have any form as a product and may be, for example, in the form of liquid, paste, gel, bar, tabulet, powder, particles or the like. The detergent of the present invention can be applied to any application in which a detergent has conventionally been used, including clothes washing, dish washing, human body washing, and hard surfaces washing.

Lime soap is often deposited with oily components in various places such as a bath tub, tiles in a bath room, a washstand, the inside of a washing machine, toilet, water-distribution pipes, and a kitchen of a restaurant. Such lime soap deposited with oily components is generally quite difficult to remove. When the lime soap deposited with oily components is removed for cleaning, the degree of attachment of the lime soap and the substance which is attached together with the lime soap vary depending on the type of the object to be cleaned. Therefore, detergents with various compositions can be used according to the purpose of the application and the object to be applied. The cleaning composition of the present invention may be solid, although a cleaning composition is supplied in a liquid state, in general. The components of the cleaning composition is selected in an appropriate manner from the group consisting of soap, a surfactant, an abrasive, an oxidant, an acid, an alkali, a pH buffer, a chelating agent, a perfume, a colorant and a solvent such alcohol, in accordance with each object or material to be cleaned.

The present invention will be described further in detail by examples and comparative examples, hereinafter. However, it should be noted that the present invention is by no means restricted to these examples and comparative examples.

EXAMPLES

Example 1

0.15 g of nonionic polyester "TexCare SRN-300" manufactured by Clariant GmbH was charged in a 1-liter beaker. Ion-exchange water was added to the beaker such that the total volume of the mixture was 1 liter. The mixture was stirred and dissolved at the room temperature, whereby an aqueous solution of the nonionic polyester (the concentration thereof was 0.15 g/L) was prepared. 0.5 g of toilet soap ("Kao White"), which had been made powdery by scraping, was added to 500 ml of the prepared aqueous solution and the mixture was stirred to dissolve. Thereafter, 4 ml of 10% aqueous solution of calcium chloride-$6H_2O$ was added to the solution. The mixture was stirred for five minutes and stood for 10 minutes. Thereafter, the state of the liquid was visually observed. Further, after standing the liquid overnight at the room temperature, the solution in the beaker was discarded by gently tilting the beaker and the state of lime soap attached to the beaker was visually observed. The result of the observation is shown in Table 1.

Example 2

Comparative Example

Comparative example 2 was carried out in the same manner as that of example 1 except that no nonionic polyester was used. The result shown in Table 1 was obtained.

Example 3

Reference Example

Reference example 3 was carried out in the same manner as that of example 1 except that 0.10 of nonionic polyester was used. The result shown in Table 1 was obtained.

TABLE 1

| | | State of liquid after Standing for 5 minutes | | |
|---|---|---|---|---|
| | Amount of added lime soap dispersant (g) | State of liquid | Presence/ absence of lime soap layer | State of attachment of lime soap to the wall of beaker |
| Example 1 | 0.15 | Opaque (white) | Absent | Absent |
| Comparative Example 2 | 0 | Trans-parent | Present | Attached by a large amount |
| Reference Example 3 | 0.10 | Slightly opaque (white) | Present | Attached by a small amount |

Example 4

1.0 g of toilet soap, which had been made powdery by scraping, was charged in a 500 ml beaker. ion-exchange water was added to the beaker and the mixture was stirred, whereby a soap solution was prepared. 5 ml of 10% aqueous solution of calcium chloride was added to the soap solution to separate lime soap. The detergent for cleaning a hard surface (e.g., a bath room) having the constitution described in Prescription 1 of Table 2 was added to the aforementioned soap solution by 0.5 ml at a time. The total amount of the detergent added until the attachment of lime soap to the inner wall surface was no longer observed was confirmed by visual observation. The result is shown in Table 3.

Example 5

Comparative Example

Comparative example 5 was carried out in the same manner as that of example 4 except that the detergent having the constitution described in Prescription 2 of Table 2 was used as the detergent for cleaning a hard surface. The result of Table 3 was obtained.

TABLE 2

| (Components) | Prescription 1 (weight %) | Prescription 2 (weight %) |
|---|---|---|
| POE(12) lauril ether | 3.0 | 3.0 |
| Sodium salt of POE(2) lauril Ether sulfuric acid | 2.0 | 2.0 |
| Ethyl cellosolve | 5.0 | 5.0 |
| TexCare SRN-300 | 2.0 | 0 |
| Ion-exchange water | Remainder | Remainder |

TABLE 3

| | Example 4 | Comparative Example 5 |
|---|---|---|
| Total amount of detergent added until attachment of lime soap to the inner wall surface was no longer observed (ml) | 2.0 | 4.0 |

Example 6

5 g of the detergent for body washing having the constitution described in Prescription 3 of Table 4 was charged in a 500 ml beaker. 500 ml of ion-exchange water was added to the beaker. The mixture was stirred so that the detergent was dissolved. Thereafter, 5 ml of 10% aqueous solution of calcium chloride was added to the solution. The mixture was thoroughly stirred and left still. The state of lime soap was visually observed. The result is shown in Table 5.

Example 7

Comparative Example

Comparative example 7 was carried out in the same manner as that of example 6 except that the detergent for body washing having the constitution described in Prescription 3 of Table 4 was replaced with the detergent for body washing having the constitution described in Prescription 4 of Table 4. The result is shown in Table 5.

TABLE 4

| □Components□ | Prescription 3 (weight %) | Prescription 4 (weight %) |
|---|---|---|
| TEA salt of palm oil fatty acid | 30.0 | 30.0 |
| Sodium salt of POE(3) lauryl Etheracetic acid | 5.0 | 5.0 |
| CDE | 3.0 | 3.0 |
| Cellulose which has been made Cationic | 0.2 | 0.2 |
| Tex Care SRN-300 | 3.0 | 0 |
| Ion-exchange water | Remainder | Remainder |

TABLE 5

| | Example 6 | Comparative Example 7 |
|---|---|---|
| Wall of beaker (liquid level) | No attachment of lime soap | Attachment of lime soap |
| Liquid | White emulsion | White emulsion |

Example 8

Example 8 was carried out in the same manner as that of example 1 except that the nonionic polyester "TexCare SRN-300" manufactured by Clariant GmbH as the lime soap dispersant was replaced with an anionic polyester ("TexCare SRA-100"manufactured by Clariant GmbH. The result obtained in example 8 was similar to that of example 1.

Example 9

Example 9 was carried out in the same manner as that of example 4 except that the nonionic polyester "TexCare SRN-300" manufactured by Clariant GmbH as the lime soap dispersant was replaced with an anionic polyester "TexCare SRA-100" manufactured by Clariant GmbH. The result obtained in example 9 was similar to that of example 4.

Example 10

Example 10 was carried out in the same manner as that of example 6 except that the nonionic polyester "TexCare SRN-300" manufactured by Clariant GmbH as the lime soap dispersant was replaced with an anionic polyester "TexCare SRA-100" manufactured by Clariant GmbH. The obtained result in example 10 was similar to that of example 6.

What is claimed is:

1. A detergent composition consisting of a lime soap dispersant represented by the general formula (1)

$$X\text{-}[(OR^1)_{n1}(OR^2)_{n2}]\text{-}O\text{-}A\text{-}R^3\text{-}A\text{-}(OR^4)_{n3}]_{m1}\text{-}[O\text{-}A\text{-}R^6\text{-}A\text{-}(OR^5)_{n4}]_{m2}\text{-}O\text{-}A\text{-}R^3\text{-}A\text{-}O\text{-}[(R^2O)_{n5}(R^1O)_{n6}]\text{-}X \quad (1)$$

wherein A represents a —CO— group, $R^1$ represents a $C_{2-4}$ alkylene group, $R^2$ represents a $C_{3-4}$ alkylene group, $R^3$ represents a phenylene group, naphthylene group or biphenylene group, $R^4$ represents a $C_{2-8}$ alkylene group, $R^5$ represents a $C_{2-8}$ alkylene group, $R^6$ represents a phenylene, naphthylene or biphenylene group which may be substituted with a $—SO_3M$ or —COOM group, X represents H, a $C_{1-4}$ alkyl group, $—R^7SO_aM$ group or $—R^8COOM$ group, M represents H or a water-soluble cation, and $R^7$, $R^8$ and $R^9$ independently represent a $C_{1-4}$ alkyl group, m1 and m2 are independently a number of 0 to 25 while m1+m2 is 3 to 25, n1 is a number of 1 to 40, n2 is 0 to 5, n3 is 1 to 40, n4 is 1 to 10, n5 is 0 to 5, and n6 is 1 to 40 and wherein said detergent composition comprises additives selected from the group consisting of an alkali metal salt of a fatty acid, anionic surfactants, nonionic surfactants, cationic polymers, chelating agent, citric acid and salt thereof, a builder, a bleach, a defoaming agent, a softener, a stain-reattaching-preventing agent, a stain suspending agent, a fluorescent brightener, a germicide, an antibacterial, an antiseptic, perfumes, an abrasive, a colorant, a UV absorbent, and mixtures thereof.

2. A cleaning composition consisting of a lime soap dispersant represented by the general formula (1):

$$X\text{-}[(OR^1)_{n1}(OR^2)_{n2}]\text{-}O\text{-}A\text{-}R^3\text{-}A\text{-}(OR^4)_{n3}]_{m1}\text{-}[O\text{-}A\text{-}R^6\text{-}A\text{-}(OR^5)_{n4}]_{m2}\text{-}O\text{-}A\text{-}R^3\text{-}A\text{-}O\text{-}[(R^2O)_{n5}(R^1O)_{n6}]\text{-}X \quad (1)$$

wherein A represents a —CO—group, $R^1$ represents a $C_{2-4}$ alkylene group, $R^2$ represents a $C_{3-4}$ alkylene group, $R^3$ represents a phenylene group, naphthylene group or biphenylene group, $R^4$ represents a $C_{2-8}$ alkylene group, $R^5$ represents a $C_{2-8}$ alkylene group, $R^6$ represents a phenylene, naphthylene or biphenylene group which may be substituted with a —$SO_3M$ or —COOM group, X represents H, a $C_{1-4}$ alkyl group, —$R^7SO_3M$ group, —$R^8$COOM group or —C(O)$R^9$ group, M represents H or a water-soluble cation, and $R^7$, $R^5$ and $R^9$ independently represent a $C_{1-4}$ alkyl group, m1 and m2 are independently a number of 0 to 25 while m1+m2 is 8 to 25, n1 is a number of 1 to 40, n2 is 0 to 5, n3 is 1 to 40, n4 is 1 to 10, n5 is 0 to 5, and n6 is 1 to 40, and wherein said cleaning composition comprises additives selected from the group consisting of an alkali metal salt of a fatty acid, anionic surfactants, nonionic surfactants, cationic polymers, chelating agent, citric acid and salt thereof, a builder, a bleach, a defoaming agent, a softener, a stain-reattaching-preventing agent, a stain suspending agent, a fluorescent brightener, a germicide, an antibacterial, an antiseptic, perfumes, an abrasive, a colorant, a UV absorbent, and mixtures thereof.

* * * * *